US007052202B2

(12) United States Patent
Lichtblau

(10) Patent No.: US 7,052,202 B2
(45) Date of Patent: May 30, 2006

(54) PROCESS AND APPARATUS FOR HIGHWAY MARKING

(76) Inventor: George Jay Lichtblau, 23 Pin Pack Rd., Ridgefield, CT (US) 06877

( * ) Notice: Subject to any disclaimer, the term of this patent is extended or adjusted under 35 U.S.C. 154(b) by 0 days.

(21) Appl. No.: 11/083,530

(22) Filed: Mar. 18, 2005

(65) Prior Publication Data

US 2005/0181121 A1 Aug. 18, 2005

Related U.S. Application Data

(60) Division of application No. 10/863,651, filed on Jun. 8, 2004, now Pat. No. 6,969,214, which is a continuation-in-part of application No. 10/774,199, filed on Feb. 6, 2004, now abandoned.

(51) Int. Cl.
*E01C 7/06* (2006.01)
*E01C 23/14* (2006.01)

(52) U.S. Cl. ..... 404/79; 404/12; 404/75; 427/422

(58) Field of Classification Search ..... 404/12–16, 404/72, 75, 79, 101, 108, 111, 84.05; 427/422, 427/426, 427, 201, 287, 140, 142; 264/30, 264/31, 82
See application file for complete search history.

(56) References Cited

U.S. PATENT DOCUMENTS

| | | | | |
|---|---|---|---|---|
| 3,706,684 | A | 12/1972 | Lopez | 260/18 EP |
| 3,719,630 | A * | 3/1973 | Antonen | 524/780 |
| 3,800,893 | A | 4/1974 | Ramsay et al. | 177/25 |
| 3,953,193 | A | 4/1976 | Bessen | 75/0.5 R |
| 4,128,065 | A | 12/1978 | Kelly et al. | 110/211 |
| 4,162,862 | A | 7/1979 | Harker et al. | 404/72 |
| 4,236,950 | A | 12/1980 | Eigenmann | 156/71 |
| 4,489,022 | A * | 12/1984 | Robyn et al. | 264/30 |
| 4,765,773 | A | 8/1988 | Hopkins | 404/94 |
| 4,792,468 | A | 12/1988 | Robyn et al. | 472/422 |
| 4,818,574 | A * | 4/1989 | Mottet et al. | 427/422 |
| 4,946,806 | A | 8/1990 | Willard | 501/88 |
| 4,981,628 | A * | 1/1991 | Willard | 264/30 |
| 4,988,647 | A * | 1/1991 | Mottet et al. | 501/99 |
| 5,002,805 | A | 3/1991 | Robyn | 427/309 |
| 5,013,499 | A | 5/1991 | Willard | 264/30 |
| 5,202,090 | A | 4/1993 | Zvosec et al. | 266/281 |
| 5,203,923 | A | 4/1993 | Hartman | 118/669 |
| 5,270,075 | A * | 12/1993 | Robyn et al. | 427/201 |
| 5,285,967 | A | 2/1994 | Weidman | 239/80 |
| 5,294,798 | A | 3/1994 | Hartman | 250/458.1 |
| 5,296,256 | A | 3/1994 | Hartman | 427/10 |

(Continued)

FOREIGN PATENT DOCUMENTS

GB 2004263 A * 3/1979

(Continued)

*Primary Examiner*—Thomas B. Will
*Assistant Examiner*—Alexandra Pechhold
(74) *Attorney, Agent, or Firm*—Weingarten, Schurgin, Gagnebin & Lebovici LLP

(57) ABSTRACT

A process and apparatus for forming a coherent refractory mass on the surface of a road wherein one or more non-combustible materials are mixed with one or more metallic combustible powders and an oxidizer, igniting the mixture so that the combustible metallic particles react in an exothermic manner with the oxidizer and release sufficient heat to form a coherent mass under the action of the heat of combustion and projecting this mass against the surface of the road so that the mass adheres durably to the surface of the road.

18 Claims, 3 Drawing Sheets

U.S. PATENT DOCUMENTS

| | | | | | |
|---|---|---|---|---|---|
| 5,368,232 | A | | 11/1994 | Schroeder | 239/165 |
| 5,401,698 | A | | 3/1995 | Mottet | 501/105 |
| 5,472,737 | A | | 12/1995 | Anders | 427/137 |
| 5,529,432 | A | | 6/1996 | Huynh et al. | 404/84.05 |
| 5,529,433 | A | | 6/1996 | Huynh et al. | 404/94 |
| 5,665,793 | A | | 9/1997 | Anders | 523/172 |
| 5,686,028 | A | | 11/1997 | Meynckens et al. | 264/30 |
| 5,732,365 | A | | 3/1998 | Howard et al. | 588/10 |
| 5,738,830 | A | | 4/1998 | Stoltzfus et al. | 422/111 |
| 5,753,026 | A | | 5/1998 | Kuntz et al. | 106/450 |
| 5,780,114 | A | * | 7/1998 | Meynckens et al. | 427/422 |
| 5,866,049 | A | | 2/1999 | Meynckens et al. | 264/30 |
| 5,874,491 | A | | 2/1999 | Anders | 523/457 |
| 5,928,717 | A | * | 7/1999 | Cherico et al. | 427/140 |
| 5,947,637 | A | | 9/1999 | Neuling | 404/94 |
| 5,951,201 | A | | 9/1999 | Jones | 404/94 |
| 5,970,993 | A | | 10/1999 | Witherspoon et al. | 134/1.1 |
| 6,027,281 | A | | 2/2000 | Neuling | 404/75 |
| 6,149,341 | A | | 11/2000 | Neuling | 404/75 |
| 6,337,106 | B1 | | 1/2002 | Brown | 427/341 |
| 6,372,288 | B1 | | 4/2002 | Meynckens et al. | 417/140 |
| 6,413,012 | B1 | | 7/2002 | Jones | 404/94 |
| 6,475,556 | B1 | | 11/2002 | Sobczak et al. | 427/137 |
| 2002/0193256 | A1 | | 12/2002 | Harris, Jr. | 507/200 |
| 2003/0080203 | A1 | | 5/2003 | Roth et al. | 239/101 |
| 2003/0119655 | A1 | | 6/2003 | Meyer et al. | 501/127 |

FOREIGN PATENT DOCUMENTS

| | | | | |
|---|---|---|---|---|
| GB | 2144055 | A | * | 2/1985 |
| GB | 2213812 | A | * | 8/1989 |
| JP | 05201772 | A | * | 8/1993 |
| WO | WO 9523199 | A1 | * | 8/1995 |
| WO | WO 9616917 | A1 | * | 6/1996 |

* cited by examiner

PROCESS AND APPARATUS FOR HIGHWAY MARKING

CROSS REFERENCE TO RELATED APPLICATIONS

This application is a division of U.S. patent application Ser. No. 10/863,651 filed on Jun. 8, 2004 now U.S. Pat. No. 6,969,214, which is a continuation-in-part of U.S. patent application Ser. No. 10/774,199, filed on Feb. 6, 2004, now abandoned, the priority of which is claimed under 35 U.S.C. §120 and the disclosures of which are incorporated herein by reference.

STATEMENT REGARDING FEDERALLY SPONSORED RESEARCH OR DEVELOPMENT

N/A

BACKGROUND OF THE INVENTION

The methods of "painting" lines on highways or road markings have changed very little in the past thirty years. Herein the word "painting" refers to any method of applying a coating to a road surface to form a line or road marking. Prior to this invention, there were only three widely used methods to paint lines on highways. The most common technique is to spray a chemical paint on to the road and wait for the paint to dry. The apparatus to spray this paint is typically an "air" or "airless" paint machine wherein the paint is carried by air and projected to the road surface or where the paint the forced through a small hole at very high pressure and projected onto the road surface. The "chemical spray" is the most widely used system to paint lines on highways or road markings.

The second technique to paint lines on highways is to apply a tape to the road surface wherein this tape is bonded to the road surface either with heat or with suitable chemicals. U.S. Pat. No. 4,162,862 illustrates a "Pavement Striping Apparatus and Method" using a machine to press the tape into hot fresh asphalt. U.S. Pat. No. 4,236,950 illustrates another method of applying a multilayer road marking prefabricated tape material.

A third technique is to use a high velocity, oxygen fuel ("HVOF") thermal spray gun to spray a melted power or ceramic powder onto a substrate. This is shown in U.S. Pat. No. 5,285,967.

Of the three painting methods, the first method of spraying a chemical onto the road surface and waiting for the paint to dry is the predominant technique used today.

The history of line painting indicates that there are at least three properties of "paint" which are important to the highway marking industry: (1) The speed at which the paint dries. (2) The bonding strength of the paint to the road surface. (3) The durability of the paint to withstand the action of automobiles, sand, rain, water, etc.

As discussed in U.S. Pat. No. 3,706,684 (Dec. 19, 1972), the first conventional traffic paints were based on drying oil alkyds to which a solvent, such as naphtha or white spirits was added. The paint dries as the solvent is released by evaporation. However, the paint "drying" (oxidation) process "continues and the film becomes progressively harder, resulting in embrittlement and reduction of abrasive resistance thereof causing the film to crack and peel off." The above patent describes "rapid-dry, one-package, epoxy traffic paint compositions which require no curing agent."

As described in U.S. Pat. No. 4,765,773:

"The road and highways of the country must be painted frequently with markings indicating dividing lines, turn lanes, cross walks and other safety signs. While these markings are usually applied in the form of fast drying paint, the paint does not dry instantly. Thus a portion of the road or highway must be blocked off for a time sufficient to allow the paint to dry. This, however, can lead to traffic congestion. If the road is not blocked for sufficient time to allow the paint to dry, vehicle traffic can smear the paint making it unsightly. Also in some instances the traffic will mar the marking to such an extent that the safety message is unclear, which could lead to accidents."

Low-boiling volatile organic solvents evaporate rapidly after application of the paint on the road to provide the desired fast drying characteristics of a freshly applied road marking.

The U.S. Pat. No. 4,765,773 patent illustrates the use of microwave energy to hasten the paint drying process of such solvents.

While the low-boiling volatile organic solvents promote rapid drying, "this type of paint formulation tends to expose the workers to the vapors of the organic solvents. Because of these shortcomings and increasingly stringent environmental mandates from governments and communities, it is highly desirable to develop more environmentally friendly coatings or paints while retaining fast drying properties and/or characteristics" (U.S. Pat. No. 6,475,556).

To solve this problem paints have been developed using waterborne rather than solvent based polymers or resins. U.S. Pat. No. 6,337,106 describes a method of producing a fast-setting waterborne paint. However, the drying times of waterborne paints are generally longer than those exhibited by the organic solvent based coatings. In addition the waterborne paints are severely limited by the weather and atmospheric conditions at the time of application. Typically the plaint cannot be applied when the road surface is wet or when the temperature is below −10 degrees centigrade. Also, the drying time strongly depends upon the relative humidity of the atmosphere in which the paint is applied. A waterborne paint may take several hours or more to dry in high humidity. Lastly the waterborne paints, which are generally known as "rubber based paints", are made from aqueous dispersion polymers. These polymers are generally very "soft" and abrade easily from the road surface due to vehicular traffic, sand and weather erosion.

The above patents all attempt to solve the paint drying problem when using "waterborne" paints and speeding the drying process. The present invention solves the drying problem by not using any solvents in the "painting process".

The present invention relates closely to the work done to repair coke ovens, glass furnaces, soaking pots, reheat furnaces and the like which are lined with refractory brick or castings. This process is known today as "ceramic welding".

U.S. Pat. No. 3,800,983 describes a process for forming a refractory mass by projecting at least one oxidizable substance which burns by combining with oxygen with accompanying evolution of heat and another non-combustible substance which is melted or partially melted by the heat of combustion and projected against the refractory brick. The invention is designed to repair, in situ, the lining of a furnace while the furnace is operating. Typically the temperature of the walls of the furnace is over 1500 degrees centigrade and the projected powder(s) ignites spontaneously when projected against the hot surface. In this process it is extremely important that both the oxidizable and non-combustible particles are matched chemically and thermally with the lining of the furnace.

If the thermal properties are not correct, the new refractory mass will crack off from the lining of the furnace due to the differential expansion of the materials. If the chemical composition is not correct, the new refractory mass will "poison" the melt in the furnace.

In the U.S. Pat. No. 3,800,983 patent the oxidizable and non-oxidizable particles are combined as one powdered mixture. The powder is then aspirated from the powder hopper by using pure oxygen under pressure. The resulting powder-oxygen mixture is then driven through a flexible supply line to a water-cooled lance. The lance is used to project the powder-oxygen mixture against the refractory lining of the furnace to be repaired. The powder-oxygen mixture ignites spontaneously when it impinges on the hot surface of the oven.

The object of the '983 invention and those that followed is to select the composition of the powders to match the characteristics of the refractory lining and to prevent "flashback" up the lance and back towards the operator of the equipment. "Flashback" is the process wherein the oxygen-powder stream burns so quickly that the flame travels in the reverse direction from the oxygen-powder and causes damage to the equipment and serious hazards to the equipment operator.

U.S. Pat. No. 4,792,468 describes a process similar to that above and specifically illustrates the chemical and physical properties of the oxidizable and refractory particles needed to form a substantially crack-free refractory mass on the refractory lining.

U.S. Pat. No. 4,946,806 describes a process based upon the 3,800,893 patent wherein the invention provides for the use of zinc metal powder or magnesium metal powder or a mixture of the two as the heat sources in the formation of the refractory mass.

U.S. Pat. No. 5,013,499 describes a method of flame spraying refractory materials (now called "ceramic welding") for in situ repair of furnace linings wherein pure oxygen is used as the aspirating gas and also the accelerating gas and the highly combustible materials can be chromium, aluminum, zirconium or magnesium without flashback. The apparatus is capable of very high deposition rates of material.

U.S. Pat. No. 5,002,805 improves on the chemical composition of the oxidizable and non-oxidizable powders by adding a "fluxing agent" to the mixture.

U.S. Pat. No. 5,202,090 describes an apparatus similar to that shown in U.S. Pat. No. 5,013,499. In the '090 patent, there are specific details about the mechanical equipment used to mix the powdered material with oxygen and transport the oxygen-powder combination to the lance. This apparatus also permits very high deposition rates of the refractory material without flashback.

U.S. Pat. No. 5,401,698 describes an improved "Ceramic Welding Powder Mixture" for use in the apparatus shown in the previous patents listed. This mixture requires that at least two metals are used as fuel powder and the refractory powder contains at least magnesia, alumina or chromic oxide.

U.S. Pat. No. 5,686,028 describes a ceramic welding process where the refractory powder is comprised of at least one silicon compound and also that the non-metallic precursor is selected from either CaO, MgO or FeO.

U.S. Pat. No. 5,866,049 is a further improvement on the composition of the ceramic welding powder described in U.S. Pat. No. 5,686,028.

U.S. Pat. No. 6,372,288 is a further improvement on the composition of the ceramic welding powder wherein the powder contains at least one substance which enhances production of a vitreous phase in the refractory mass.

BRIEF SUMMARY OF THE INVENTION

The invention provides a method of and apparatus for flame spraying refractory material directly onto a road surface to provide a highly reflective, very durable and instant drying "paint" to said road surface. Since the paint contains no solvents and the flame spraying process operates at very high temperatures, the "paint" can be applied under widely varying conditions of temperature and humidity.

The present invention makes use of a ceramic welding process in which a non-combustible ceramic powder is mixed with a metallic fuel and an oxidizer. The mixture is transported to a combustion chamber, ignited and projected against the surface of the road. Alternately, the constituents can be mixed in the combustion chamber. The fuel is typically aluminum powder and the non-combustible ceramic powder is typically silicon or titanium dioxide. The oxidizer is typically a chemical powder, but can also be pure oxygen. The heat of combustion melts or partially melts the ceramic powder forming a coherent mass that is projected against the road surface, the temperature of the materials causing the coherent mass to adhere durably to the surface.

The object of the present invention is to present a method of "painting" lines on roads, wherein the "paint" dries instantly, adheres durably to the road, has extreme resistance to abrasion and erosion, wind, sand and rain, and is inherently safe from "flashback". This "paint" can be applied at any temperature and under wet and rainy conditions. The operating temperature of the combustion chamber is typically on the order of 3000 degrees Kelvin.

BRIEF DESCRIPTION OF THE SEVERAL VIEWS OF THE DRAWINGS

The invention will be more fully described in the following detailed description taken in conjunction with the drawings in which.

DETAILED DESCRIPTION OF THE INVENTION

Figure 1:
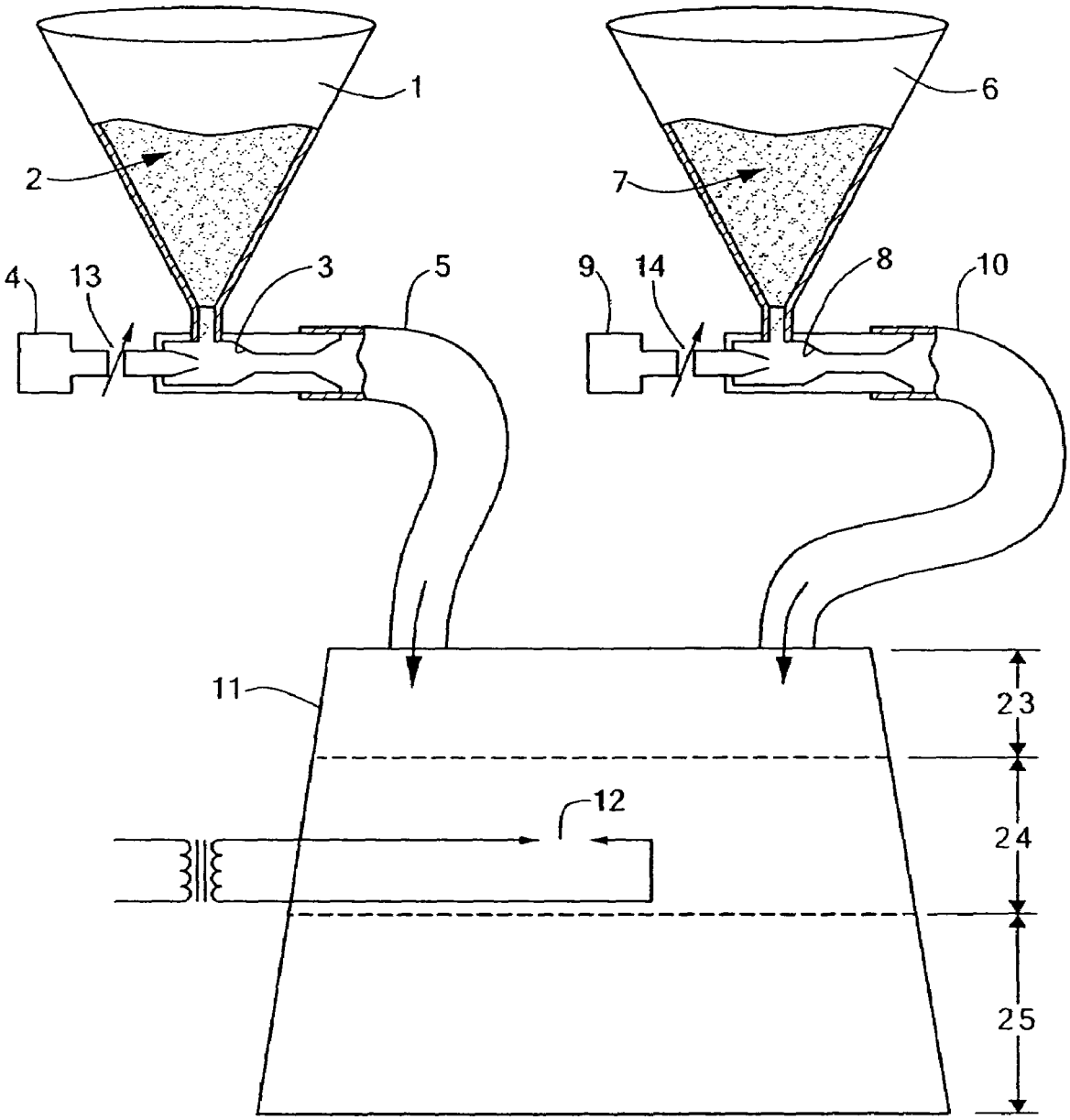
FIG. 1 is a diagrammatic representation of apparatus in accordance with the invention.

FIG. 1 illustrates a typical embodiment of apparatus employed in this invention. Hopper (1) contains the metallic fuel powder (2) typically aluminum powder or silicon powder. Other suitable combustible powders include zinc, magnesium, zirconium, and chromium. Mixtures of two or more combustible powders can also be used. Hopper (6) contains the powdered chemical oxidizer (7), typically ammonium, potassium or sodium nitrate. The non-combustible ceramic material, typically silicon or titanium dioxide, can be combined with the fuel powder, the chemical oxidizer or both. Each hopper feeds the powder by gravity into a venturi (3 and 8) fed by air or oxygen (4 and 9). The gas flowing through the venturi is controlled by valves (13) or (14) and aspirates the powder into the air stream. The air streams from both hoppers travel in separate supply lines (5) and (10) and combine in the combustion chamber (11) where the airstreams are mixed and ignited, typically by an electric arc (12) or gas fed pilot light or plasma arc. The resulting combustion melts at least the surface of the non-combustible materials and the air streams project the melted material onto the road surface. The materials form a coherent ceramic or refractory mass that adheres durably to the surface of the road.

In FIG. 1 each hopper has its own supply line (5 and 10) and each supply line goes directly to the top portion of the combustion chamber (11). The combustion chamber has three areas of interest: The top portion (23) is where the metallic fuel and oxidizer mix; the middle portion (24) is where the fuel is ignited and high temperature burning takes place; and the lower portion (25) is the lowest temperature portion of the combustion chamber where secondary combustion effects take place.

In FIG. 1, the oxidizer may be pure oxygen supplied from a source (9) and controlled by variable valve (14). The oxygen goes via supply line (10) directly to the combustion chamber (11). In this case no powdered oxidizer is required and the second hopper (6) is not required. It is important that only air be used to aspirate the powdered fuel (2) from the hopper to the combustion chamber (11). The use of air to aspirate the fuel eliminates the possibility of "flashback" to the powdered fuel.

Figure 2:
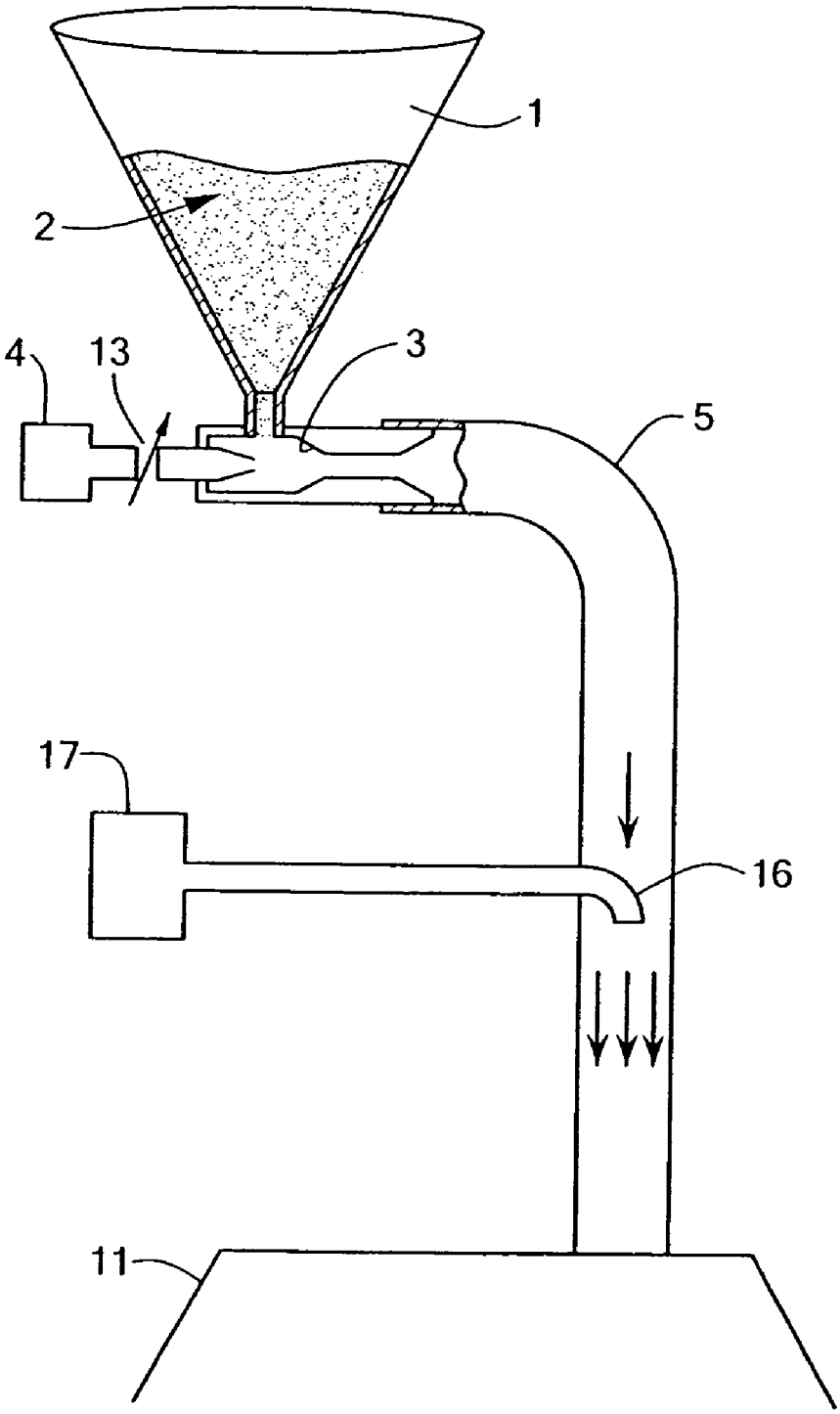
FIG. 2 is a diagrammatic representation of an alternative embodiment of the apparatus according to the invention.

FIG. 2 illustrates another method of injecting pure oxygen into the combustion chamber. In this illustration, the powdered fuel is aspirated into the supply line (5) and driven towards the combustion chamber (11). At a point in the supply line (6) that is close to the combustion chamber, a supply of oxygen is injected into the supply line at point 16 from a source of oxygen (17). This oxygen accelerates the fuel-air mixture and supplies the oxygen necessary for combustion. The injection of oxygen close to the combustion chamber prevents "flashback" since the fuel is aspirated with air up to point number 16. Air is insufficient to maintain combustion of the powdered fuel. Therefore, the powdered fuel-air mixture cannot burn in the reverse direction towards the hopper (1). By injecting the oxygen into the supply line (6), the oxygen aides in the acceleration of the fuel and ceramic powder mixture towards the road surface and also promotes better mixing of the powdered fuel with the oxygen.

This process is inherently safe from "backflash" because the typical aluminum-powdered or silicon-powdered fuel is transported by air and is separated from the chemical oxidizer until the chemicals are combined in the combustion chamber (11). It is almost impossible to cause aluminum or silicon powder to backflash when transported by plain air. In addition, the oxidizer does not burn (or burns very slowly) in air thus preventing any backflash in the supply line (10) transporting the chemical oxidizer.

Another safety feature is that aluminum or silicon powder is very difficult to ignite in air. While there are many cautions regarding the use of aluminum powder, the aluminum powder cannot ignite in air unless the flame temperature (from a match etc) exceeds the melting temperature of aluminum oxide (2313 K). This inventor has run experiments with several particle sizes of aluminum powder; i.e. 1 micron up to 100 microns and has been unable to ignite any of the powders using a propane torch.

In addition, the non-combustible ceramic powder may be mixed with the metallic combustible powder or the powdered oxidizer. If the non-combustible powder is mixed with the powdered fuel, it will dilute the concentration of the powdered fuel and minimize the possibility of flashback or accidental ignition of the fuel. According to the various ceramic welding patent disclosures, the quantity of the powdered fuel will typically be less than 15% by weight of the non-combustible ceramic powder.

In other cases, air alone, without supplemental pure oxygen, is sufficient to supply the oxygen needed for combustion. In this case, air can be injected at point 16 of FIG. 2 to accelerate the mixture toward the surface and promote better mixing of the powdered fuel with the air.

Figure 3:
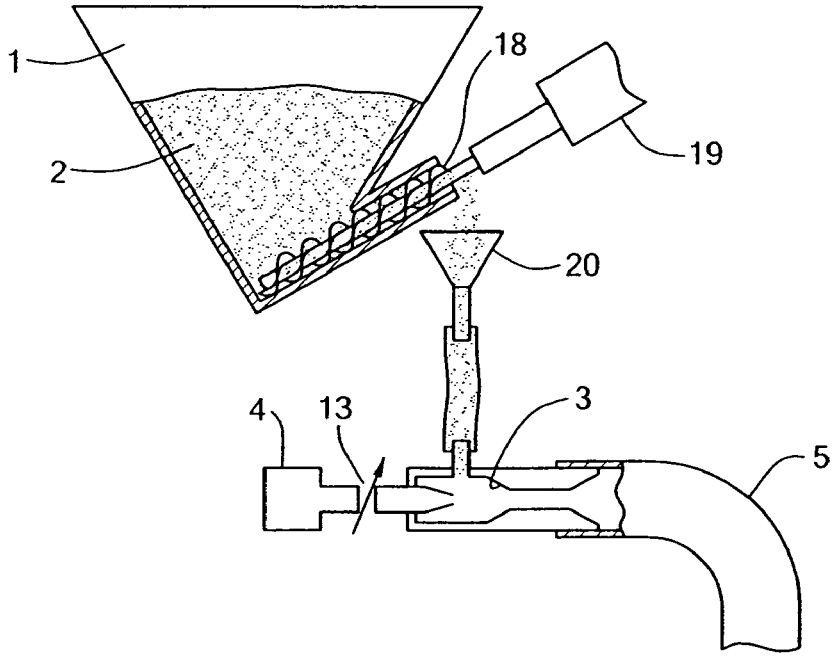
FIG. 3 is a diagrammatic representation of a further embodiment of the apparatus according to the invention.

FIG. 3 illustrates in greater detail the apparatus used in this invention. The hopper (1) contains either the powdered fuel (2) or the powdered oxidizer (7). The powders are fed by a screw conveyer (18) which is driven by a variable speed motor (19). The screw conveyor feeds into a funnel (20) which is in fluid communication with an aspirator (3) into which a stream of air from source (4) is directed. The rate of flow of the air stream is controlled by valve (13) in series with the air source (4). The venturi aspirates the powdered fuel from the funnel into the supply line (5) wherein the entrained particles are delivered to the combustion chamber (11). The rate of deposition of the coherent mass onto the surface can be controlled by the rate of movement between the surface and the exit of the combustion chamber. The variable speed motor along with the screw conveyor and the air control valve (13) provide an accurate means of dispensing the powdered fuel(s) and oxidizer to the combustion chamber and varying the rate of combustion and deposition of the refractory materials onto the road surface. The variable speed motor and air control valve (13) are controlled by a device which measures the speed of the "line painting machine" relative to the surface of the road. In this manner the thickness of the deposition on the road surface can be controlled independently of the speed of the line painting apparatus relative to the surface of the road. The surface may be preheated prior to projecting the refractory mass thereon.

The choice of oxidizing chemical is very important to the safety and economics of this line painting process. The oxidizing chemical must be low cost, readily available, non-toxic, and burn with a flame temperature sufficiently high to soften or melt the ceramic materials used in this process. The following chemicals were considered:

Ammonium Perchlorate (NH4CL04)
Ammonium Nitrate (NH4NO3)
Potassium Nitrate (KNO3)
Sodium Nitrate (NaNO3)
Potassium Perchlorate (KCLO4)
Sodium Perchlorate (NaCLO4)
Potassium Chlorate (KCLO3)
Sodium Chlorate (NaCLO3)
Air
Pure oxygen Ammonium perchlorate is a well known and well characterized oxidizer used in solid state rocket fuels. It is the oxidizer for the solid rocket boosters for the space shuttle. It is relatively expensive and made by only one company in the United States. The combustion products are primarily NO and a small amount of $NO_2$, chlorine and hydrogen chloride (HCL), all of which are toxic. Therefore, ammonium perchlorate was ruled out for use as the oxidizer in this application.

Ammonium nitrate ($NH_4NO_3$) is one of the better oxidizers because it contains no chlorine and therefore produces no HCL. It may generate toxic amounts of NO, although the concentration of the NO when combined with free air is likely to be very low. Ammonium nitrate is also known as fertilizer and widely used in explosives. It is widely available and inexpensive. However, it takes 4.45 pounds of ammonium nitrate to burn one pound of aluminum and therefore ammonium nitrate will require larger volumes and weight than other potential oxidizers.

Potassium nitrate ($KNO_3$) and sodium nitrate ($NaNO_3$) are widely available, very inexpensive and will also generate a toxic amount of NO. Again, it is expected that the NO will be very much diluted with free air in the operation of this machine. Both potassium nitrate and sodium nitrate will generate byproducts which will react with air to create hydroxides. These hydroxides are soluble in water and may (or may not) cause problems with the deposition and adherence of the refractory material on the road surface. Only 2.25 pounds of $KNO_3$ are required to burn one pound of aluminum. Therefore, $KNO_3$ is a very good candidate for the oxidizer.

Sodium nitrate ($NaNO_3$) has very similar properties to $KNO_3$. It is readily available, low cost and only requires 1.89 pounds of KNO3 to burn one pound of aluminum.

The other perchlorate and chlorates are similar in performance and combustion properties to sodium and potassium nitrate and will also generate byproducts that are water soluble. They are more expensive and less available than sodium and potassium nitrate.

Air is a very good candidate for use as the oxidizer. Obviously it is readily available and only requires a compressor. The question is can sufficient air be injected into the system to supply sufficient oxygen for the combustion and also not drain too much of the heat away.

Pure oxygen is an excellent candidate for the oxidizer. Using pure oxygen would create a process very similar to ceramic welding. There are no toxic byproducts and the valves and controls are inexpensive. Pure oxygen is very inexpensive and readily available. If compressed oxygen (as a gas) is used, the containers are very large and heavy relative to the amount of oxygen stored. Also, the problem of "flashback" must be addressed.

Liquid oxygen is a very good candidate for large volume highway painting applications. It is very inexpensive and widely available. The only problem is the storage and handling of the LOX.

The following non-combustible ceramic materials were considered for use as the "paint pigment" in this apparatus:

Silicon Dioxide
Titanium Dioxide
Aluminum Oxide
Chromium Oxide produced from refused grain brick.
Magnesium Oxide
Iron Oxide
Crushed colored glass
Magnesite regenerate
CORHART-ZAC refractory materials $Al_2O_3$-/Bauxite-Regenerate The prime criteria for selection of the "paint pigment" are cost and availability. Titanium dioxide is the prime pigment used in white paints, is readily available, and is very low in cost. Aluminum oxide is also readily available, but is much more costly than titanium dioxide. Silicon dioxide is normally known as "sand" and may be the least expensive of all of the "paint pigments". Chromium oxide, if produced from refused grain brick, is also a low cost ceramic material, but may not be consistent in its mixture. Refused grain brick is available commercially as, for example, COHART RFG or COHART 104 Grades. Magnesium oxide may be used in small amount to enhance the thermal properties of the final paint product. Magnesite regenerate, CORHART-ZAC refractory materials, and bauxite-regenerate are recycled refractory products that were previously used in high temperature furnaces. A mixture of two or more non-combustible ceramic materials can be used.

In one embodiment, at least two non-combustible materials are mixed with at last one metallic combustible powder and an oxidizer. One of the non-combustible materials has a melting point in excess of the flame temperature of the burning metallic powder and oxidizer, and the second non-combustible material has a melting point that is lower than the flame temperature of the burning metallic powder and the oxidizer. The mixture is ignited so that the combustible particles react in an exothermic manner with the oxidizer and release sufficient heat to melt the lower melting point non-combustible material but not sufficient to melt the higher melting point non-combustible material. The materials are then projected onto the surface, and the lower melting point non-combustible material acts as a glue for the higher melting point non-combustible material and the products of combustion, and the resulting mass adheres durably to the surface. Preferably, the higher melting point non-combustible material includes titanium dioxide, aluminum oxide, magnesium oxide, chromium oxide, iron oxide, zirconium oxide, tungsten oxide or a mixture of two or more of these. The lower temperature non-combustible material is silicon dioxide and the metallic combustible powder is silicon.

Some line painting compositions that are suitable for coating a road surface include a composition comprising titanium dioxide and silicon; a composition comprising titanium dioxide, silicon dioxide, and silicon; a composition comprising aluminum oxide and silicon; a composition comprising aluminum oxide, silicon dioxide, and silicon; a composition comprising iron oxide and silicon; a composition comprising iron oxide, silicon dioxide, and silicon; a composition comprising magnesium oxide and silicon; and a composition comprising magnesium oxide, silicon dioxide, and silicon.

In addition to the selection of low cost ceramic materials for use as "paint pigment", there is a requirement for coloring materials to produce the colors of yellow, blue and red on road surfaces. These coloring materials may be pre-mixed with the ceramic powder or powdered fuel, or may be added to the combustion chamber via a separate supply line. The coloring material can be, for example, tungsten, zirconium, crushed yellow or another color glass, or ferric oxide ($Fe_2O_3$). Similarly, retro-reflective beads can be added.

Since the oxidizer powders tend to be hygroscopic, it is necessary to add "anti-caking" agents to the powder to prevent the formation of clumps, which inhibits the powder from flowing smoothly. The "anti-caking" agent is also known as a "flow" agent. The typical flow agent is TCP (tri-calcium phosphate), although others are well known in the art.

Figure 4:
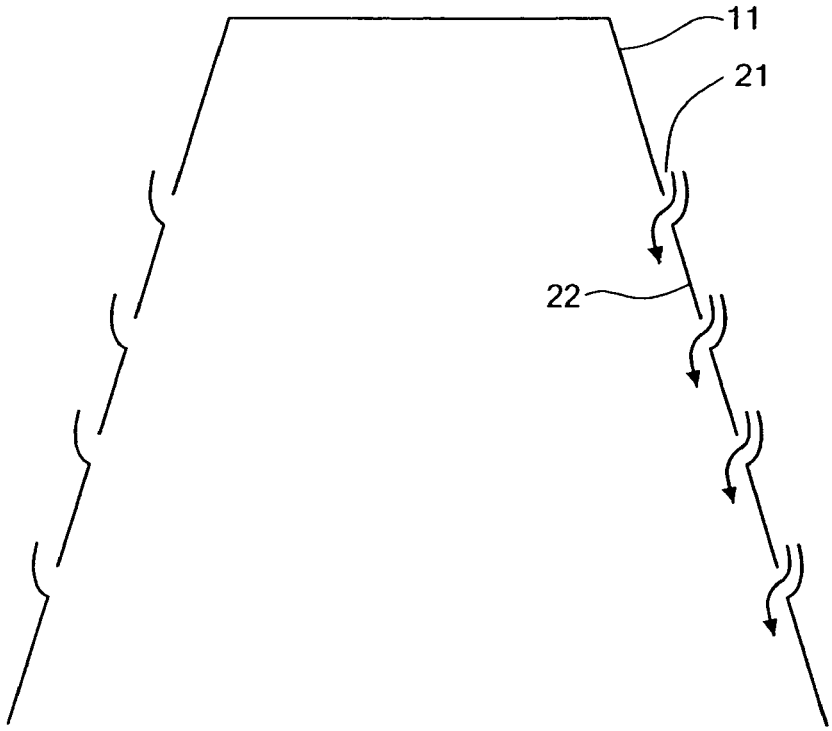
FIG. 4 is a diagrammatic representation of one embodiment of a combustion chamber employed in the invention.

FIG. 4 illustrates one aspect of the combustion chamber (11). Since the apparatus operates at extremely high temperature, typically above 3000 degrees Kelvin, it is important that the combustion chamber be designed to be low cost and have a very long life at elevated temperature. The combustion chamber may be made of a suitable ceramic material or a metal that is coated on the inside with a high temperature ceramic coating. FIG. 4 illustrates the use of small venturies (21) built into the sides of the combustion chamber. As the combustion products are projected from the combustion chamber (11), the velocity of the combustion gases create a partial vacuum on the inside surface of the combustion chamber. Cooler air is sucked into the venturi entrance (21) and flows along the inside of the combustion chamber (22). This air both cools the inside surface of the combustion chamber and also reduces the build up of residual products on the inside of the combustion chamber.

The invention is not to be limited by what has been particularly shown and described and is to encompass the full spirit and scope of the appended claims.

What is claimed is:

1. A process for forming a coherent refractory mass on the surface of a road comprising the steps of:

providing a road marking composition comprising at least one non-combustible dry powder and at least one combustible dry powder, wherein when the mixture is ignited in the presence of an oxidizer, the combustible powder reacts in an exothermic manner with the oxidizer and releases sufficient heat to form a refractory mass under the action of the heat of combustion and cause the refractory mass to adhere durably to the surface of a road mixing one or more non-combustible materials with one or more metallic combustible powders and an oxidizer;

igniting the mixture in a combustion chamber so that the combustible particles react in an exothermic manner with the oxidizer inside the combustion chamber and release sufficient heat to form a high temperature coherent refractory mass under the action of the heat of combustion; and projecting said high temperature mass from the combustion chamber onto the surface of the road so that the mass adheres durably to the surface of the road.

2. The process of claim 1 wherein the non-combustible powder is selected from the group consisting of titanium dioxide, aluminum oxide, silicon dioxide, chromium oxide, magnesium oxide, iron oxide, zirconium oxide, or a mixture of two or more thereof; and wherein the combustible powder is selected from the group consisting of aluminum, silicon, zinc, magnesium, chromium, zirconium, or a mixture of two or more thereof.

3. The process of claim 1 wherein the oxidizer is selected from the group consisting of air, compressed oxygen, liquid oxygen, ammonium perchlorate, ammonium nitrate, potassium perchlorate, potassium nitrate, sodium perchlorate, sodium nitrate, potassium chlorate and sodium chlorate or a mixture of two or more thereof.

4. The process of claim 1 wherein the non-combustible powder is known commercially as CORHART RFG or CORHART 104 Grades.

5. The process of claim 1 where the non-combustible material is Magnesite regenerate.

6. The process of claim 1 wherein the non-combustible material is aluminum oxide/Bauxite-Regenerate.

7. The process of claim 1 including iron oxide used as a catalyst in the mixture.

8. The process of claim 1 including a coloring material that, when heated in the presence of the other materials, causes the color of the refractory mass to be a predetermined color.

9. The process of claim 8 wherein the coloring material produces a color of yellow, red or blue.

10. The process of claim 8, wherein the coloring material consists of tungsten, zirconium, iron oxide, or crushed colored glass.

11. The process of claim 1, wherein the road marking composition comprises titanium dioxide and silicon.

12. The process of claim 1, wherein the road marking composition comprises titanium dioxide, silicon dioxide, and silicon.

13. The process of claim 1, wherein the road marking composition comprises aluminum oxide and silicon.

14. The process of claim 1, wherein the road marking composition comprises aluminum oxide, silicon dioxide, and silicon.

15. The process of claim 1, wherein the road marking composition comprises iron oxide ($Fe_2O_3$) and silicon.

16. The process of claim 1, wherein the road marking composition comprises iron oxide ($Fe_2O_3$), silicon dioxide, and silicon.

17. The process of claim 1, wherein the road marking composition comprises magnesium oxide and silicon.

18. The process of claim 1, wherein the road marking composition comprises magnesium oxide, silicon dioxide, and silicon.

* * * * *

UNITED STATES PATENT AND TRADEMARK OFFICE

CERTIFICATE OF CORRECTION

PATENT NO. : 7,052,202 B2
APPLICATION NO. : 11/083530
DATED : May 30, 2006
INVENTOR(S) : George Jay Lichtblau It is certified that error appears in the above-identified patent and that said Letters Patent is hereby corrected as shown below:

Column 2, line 36, “plaint” should read --paint--.

Signed and Sealed this

Nineteenth Day of June, 2007

JON W. DUDAS
*Director of the United States Patent and Trademark Office*